US012559951B2

(12) United States Patent
Sighinolfi

(10) Patent No.: US 12,559,951 B2
(45) Date of Patent: Feb. 24, 2026

(54) LEVELLING SPACER SYSTEM

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 188 days.

(21) Appl. No.: 18/466,095

(22) Filed: Sep. 13, 2023

(65) Prior Publication Data

US 2024/0102295 A1 Mar. 28, 2024

(30) Foreign Application Priority Data

Sep. 21, 2022 (IT) ..... 102022000019335

(51) Int. Cl.
*E04F 21/00* (2006.01)

(52) U.S. Cl.
CPC ..... *E04F 21/0092* (2013.01)

(58) Field of Classification Search
CPC ... E04F 21/0092; E04F 21/22; E04F 21/1844; E04F 21/1877; E04F 13/0892; E04F 15/02005
See application file for complete search history.

(56) References Cited

U.S. PATENT DOCUMENTS

| | | | | |
|---|---|---|---|---|
| 9,322,185 | B1 | 4/2016 | Russo | |
| 9,970,203 | B1 * | 5/2018 | Abidov | E04F 21/1877 |
| 2021/0062522 | A1 | 3/2021 | Peter | |

FOREIGN PATENT DOCUMENTS

| | | | | |
|---|---|---|---|---|
| BE | 815222 | A | 9/1974 | |
| CN | 113818673 | A | 12/2021 | |
| EP | 3584389 | A1 | 12/2019 | |
| WO | WO-2011121476 | A1 * | 10/2011 | E04F 15/02005 |

* cited by examiner

*Primary Examiner* — Babajide A Demuren
(74) *Attorney, Agent, or Firm* — FisherBroyles, LLP; Roger L. Browdy; Ronni S. Jillions

(57) ABSTRACT

A levelling spacer system for laying tiles for coating surfaces, including a block equipped with a base positionable posteriorly to a laying surface of at least two adjacent tiles and flanked with respect to a flanking direction, and a separating element rising from the base at right angles thereto capable of being inserted between side walls facing said two flanked tiles, the separating element including a through window, a shaped edge of which is placed at a distance from the base greater than a maximum height of a visible surface of the tiles from the base itself, a pressure wedge to be inserted at least partially into the through window between the visible surface of the tiles and the shaped edge along a crossing direction parallel to the flanking direction. and a plate to be interposed between the pressure wedge and the visible surface of the tiles with a surface facing the base. The plate is configured to be inserted at least partially into the through window between the visible surface of the tiles and the pressure wedge along the crossing direction.

10 Claims, 7 Drawing Sheets

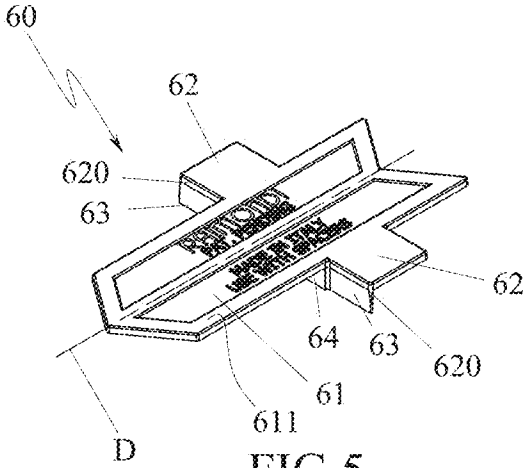
FIG.5
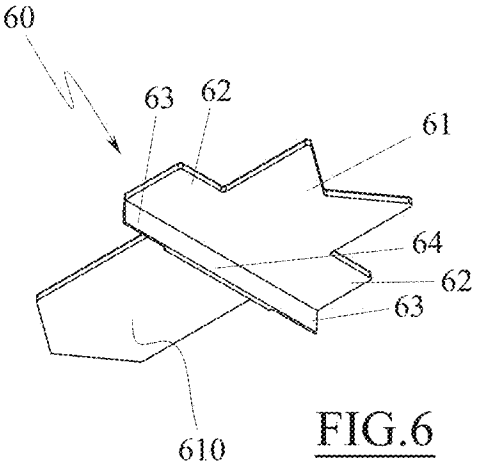
FIG.6
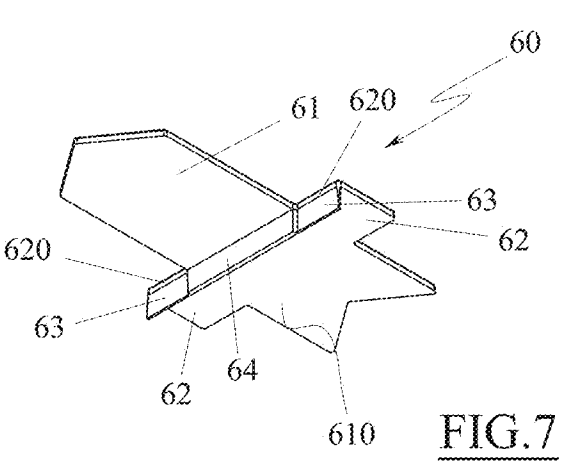
FIG.7
FIG.9
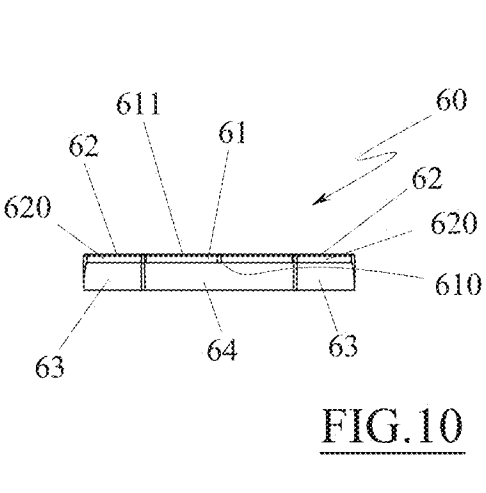
FIG.10
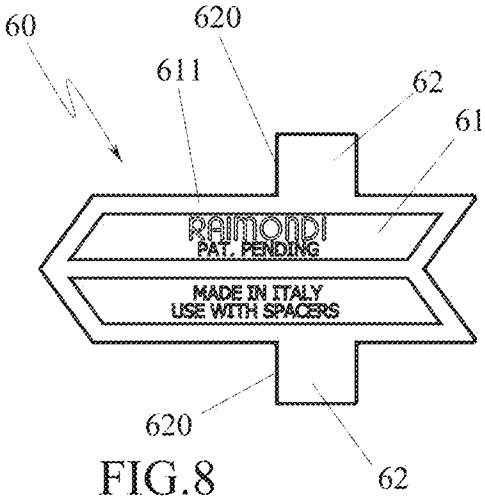
FIG.8

LEVELLING SPACER SYSTEM

TECHNICAL FIELD

The present invention relates to a levelling spacer system for laying slab-shaped products, such as tiles, slabs of natural stone or the like, for coating surfaces, such as floors and, preferably, wall coverings or the like.

PRIOR ART

In the field of laying tiles for covering surfaces, such as flooring, walls and the like, it is known to use spacer systems, which, in addition to spacing the tiles, allow their planar arrangement, i.e., they are such as to make the visible surface of the tiles substantially coplanar; said devices are commonly called levelling spacer devices. The known levelling spacer devices generally comprise a block, having a base which can be positioned below the laying surface of at least two (three or four) adjacent tiles, from which at least one separating element rises, that is capable of being inserted between the facing side walls of the two (three or four) tiles to be placed as flanked on the laying surface and of protruding beyond the visible surface of the slab-shaped products themselves.

The levelling spacer device is also equipped with a pressure element cooperating with the portion of the separating element which rises above the plane defined by the visible surface of the tiles. The pressure element is essentially equipped with a planar surface facing the base which is adapted to press the visible surfaces of all the products supported by the same base towards the base itself so as to level the visible surfaces.

The known levelling spacer systems include various types thereof, one of which provides that the pressure element is substantially a wedge which slides on the visible surface of the products and enters a window (open or closed) formed in the separating element to press on the visible surface of the tiles and push them towards the base.

A further type of such levelling spacer systems is that of the so-called screw levelling spacer systems and provides that the pressure element is essentially formed by a knob equipped with a nut screw which is capable of being screwed onto a threaded stem (or similar) associated with the raised portion of the separating element.

Other types provide that the pressure means can be of the ring type or sliders that slide vertically.

Once the pressure element has performed its task of levelling the tiles and having waited for the adhesive, on which the tile laying surfaces are laid, to solidify, it is sufficient to separate—for example thanks to appropriately predetermined fracture lines formed between the separating element and the base or along the separating element—the separating element from the side of the device containing the base which will remain immersed in the adhesive concealed below the laying surface of the tiles.

Some slab-shaped products, such as glazed or coated tiles that are generally used for covering vertical walls, are particularly delicate, especially at the interface between the glaze and the tile body supporting the glaze, and while using such levelling spacer systems, the interaction/rubbing between the pressure element and/or separating element with the glaze can result in local surface defects, such as abrasions or scratches (due to parts of the laying system rubbing against the visible surface of the tiles) and/or chipping, e.g. at the visible edge of the tile (e.g. due to bending of the separating element caused by the interaction with the pressure element).

In order to overcome these drawbacks, anti-rubbing and/or anti-chipping plates have been developed over the years, as for example disclosed in Patent EP 3 584 389 A1 to the Applicant.

In such laying systems, or other known laying systems, the anti-rubbing plate has a slot which is inserted, substantially to measure or with a small clearance, on the portion rising from the tiles of the pressure element, and then the pressure element acts thereon.

A need perceived in the field is, however, to allow for the possibility of making the protection plates compatible with as many blocks and pressure elements as possible, which may vary depending on the tile format to be laid, various circumstances and, moreover, from manufacturer to manufacturer.

In addition, a need perceived in the field is to be able to save materials (plastics, in particular) to manufacture such levelling systems, thus reducing the environmental impact, volume, weight and cost thereof.

An object of the present invention is to comply with these and other needs of the prior art, with a simple, rational and cost-effective solution.

These objects are achieved by the features of the invention set forth in the independent claim. The dependent claims outline preferred and/or particularly advantageous aspects of the invention.

DISCLOSURE OF THE INVENTION

The invention, in particular, makes available a levelling spacer system (1) for laying tiles (P) for coating surfaces, comprising:

- a block (10) equipped with
  - a base (20) positionable posteriorly to a laying surface (P1) of at least two tiles (P) arranged adjacent and flanked with respect to a flanking direction (A); and
  - a separating element (30) which rises from said base (20) at right angles thereto and is capable of being inserted between side walls (P3) facing said two flanked tiles (P), wherein the separating element (30) comprises a through window (40), a shaped edge (320) of which facing the base (20) is placed at a distance from the base (20) greater than a maximum height of a visible surface (P2) of the tiles (P) from the base (20) itself;
- a pressure wedge (50) suitable to be inserted at least partially into the through window (40) between the visible surface (P2) of the tiles (P) and the shaped edge (320) along a crossing direction (B) parallel to the flanking direction (A); and
- a plate (60) suitable to be interposed between the pressure wedge (50) and the visible surface (P2) of the tiles (P) with its first surface (610) facing the base (20), wherein the plate (60) is configured to be inserted at least partially into the through window (40) between the visible surface (P2) of the tiles (P) and the pressure wedge (50) along the crossing direction (B).

Thanks to this solution, the intended objects can be achieved.

In particular, by means of a simple and cheap plate, it is possible to fulfil the tile anti-scratch function by making the plate adaptable to various sizes of blocks and wedges (available on the market).

Advantageously, the plate (60) may comprise at least one striker element (62) configured to abut on at least one rear portion (311) of the separating element (30) during the insertion of the plate (60) into the through window (40) along the crossing direction (B).

Thanks to this solution, it is possible to increase the effectiveness of the system, allowing a stable (and univocal) and effective positioning of the plate with respect to the block (and thus to the tiles).

Furthermore, the separating element (30) may be equipped with two legs (31) flanked to each other along a flanking direction orthogonal to the crossing direction (B) and each rising from the base (20) and a cross member (32) joining the top of the two legs (31), which cross member (32) comprises the shaped edge (320), and wherein the plate (60) comprises two striker elements (62) each of which is configured to abut on at least one rear portion (311) of a respective leg (31) of the separating element (30) during insertion of the plate (60) into the through window (40) along the crossing direction (B).

Advantageously, the plate (60) may comprise at least one blade (63) configured to be inserted between a side wall (P3) of a tile (P) and the separating element (30). Thanks to such a solution, it is possible to effectively and congruently fulfil the tile anti-chipping function.

According to an aspect of the invention, the blade (63) can depart from the striker element (62), so that a front face of the blade (63) is substantially flush with an abutment surface (620) of the striker element (62).

Advantageously, from each striker element (62) a respective blade (63) can depart at right angles to the first surface (610) of the plate (60) facing the base (20) and configured to be inserted between a side wall (P3) of a tile (P) and a rear portion (311) of a respective leg (31) of the separating element (30).

Advantageously, the striker element (62) and the blade (63) can be configured to cover an edge of at least one tile (P) joining a side wall (P3) and the visible surface (P2) thereof.

Furthermore, the plate (60) may comprise a reinforcing plate (64) joining the blades (63), wherein the reinforcing plate (64) is at right angles to the first surface (610) of the plate (60) and has a thickness greater than or equal to a maximum thickness of each blade (63).

Advantageously, the pressure wedge (50) can be provided with a longitudinal axis and can have a tapered end and an opposing enlarged end, wherein the pressure wedge (50) is configured to be inserted at least partially into the through window (40) on the side of the tapered end and to slide along the crossing direction (B) resting on a second surface (611) of the plate (60) opposite the first surface (610) cooperating with said shaped edge (320) for pushing the tiles (P) themselves towards the base (20).

In this context, the second surface (611) of the plate (60) may be parallel to the first surface (60) and completely planar, or it may have a full length longitudinal channel along the crossing direction, wherein the longitudinal channel defines a central planar bottom surface that is parallel to two opposing planar top surfaces.

Thanks to this solution, it is possible to make a block (with a wide through window) suitable by using wedges of different widths.

Alternatively, the second surface (611) of the plate (60) can be inclined with respect to the first surface (610), so that the plate (60) has an increasing thickness in the crossing direction (B).

Thanks to this solution, it is possible to reduce the feed stroke of the pressure wedge (with the same pull obtained).

BRIEF DESCRIPTION OF THE DRAWINGS

Further features and advantages of the invention will be more apparent after reading the following description provided by way of non-limiting example, with the aid of the accompanying drawings.

FIG. 5 is an upper axonometric view of a plate of the embodiment of the levelling spacer device according to the invention.

FIG. 6 is a first lower axonometric view of FIG. 5.

FIG. 7 is a second lower axonometric view of FIG. 5.

FIG. 8 is a plan view of FIG. 5.

FIG. 9 is an elevation side view of FIG. 5.

FIG. 10 is an elevation front view of FIG. 5.

FIGS. **16-16*f*** are an operating sequence of the levelling spacer system according to the invention.

Figure 2:
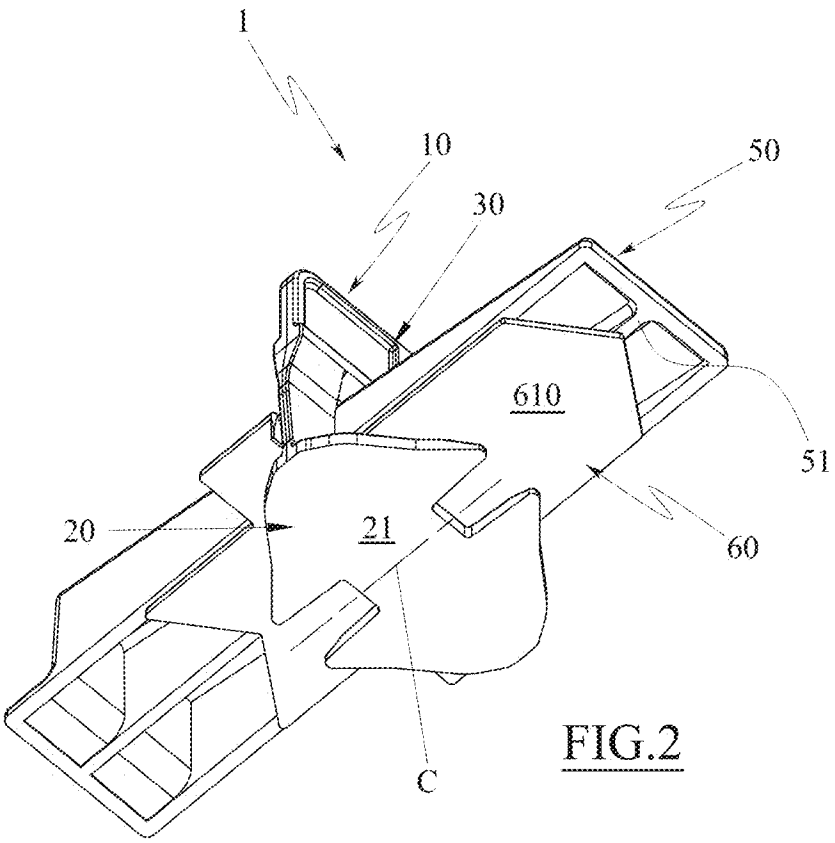
FIG. 2 is a lower axonometric view of FIG. 1.
Figure 1:
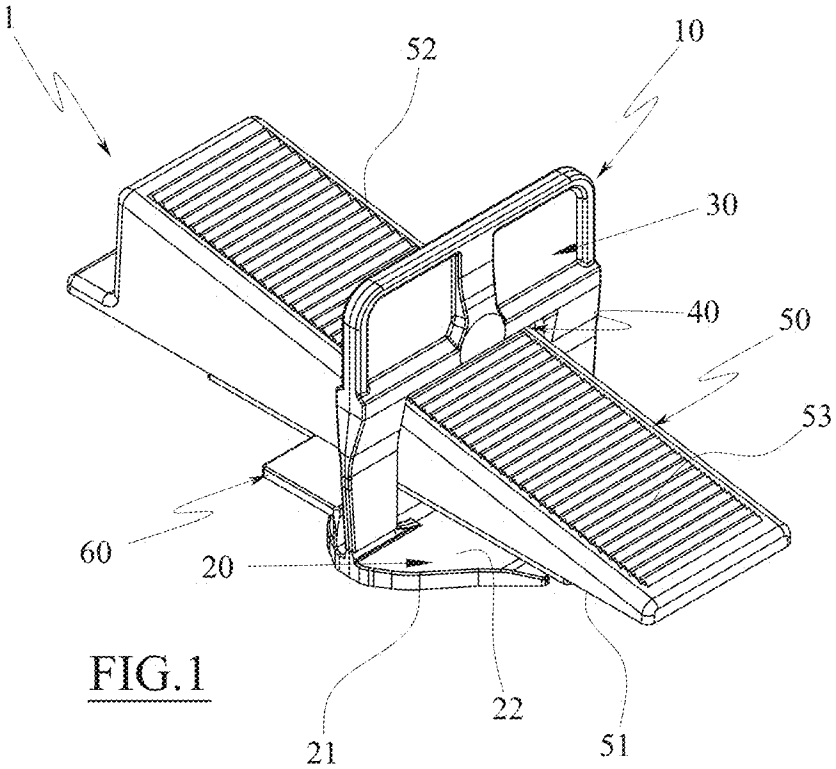
FIG. 1 is an upper axonometric view of a first embodiment of the levelling spacer system according to the invention.
Figure 4:
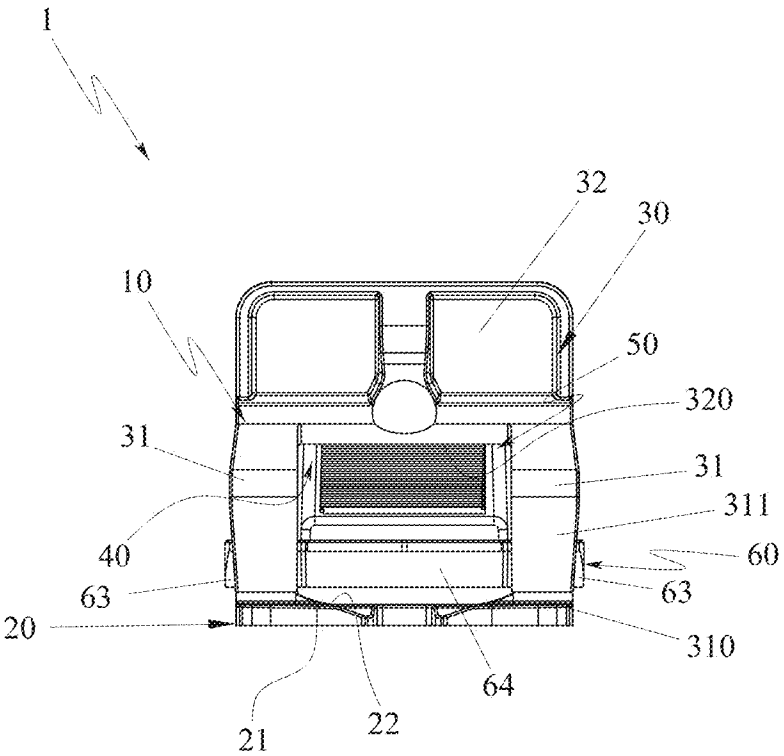
FIG. 4 is an elevation front view from IV of FIG. 3.
Figure 17:
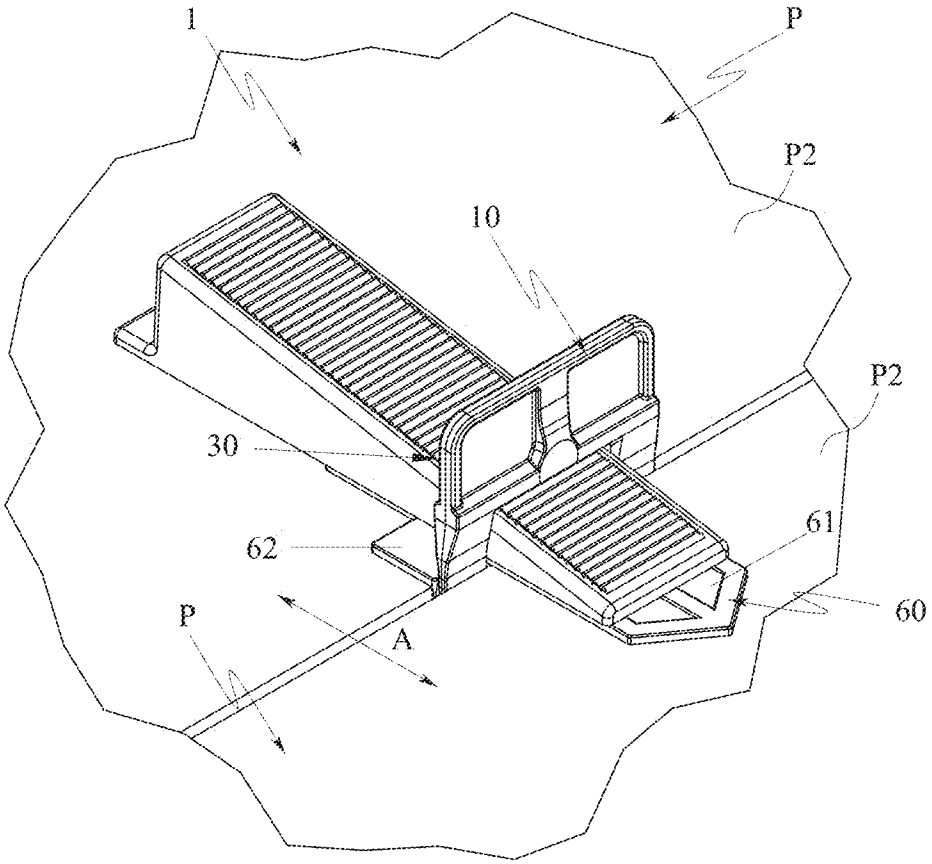

FIG. 17 is an axonometric view from above of the system of FIG. 1 in a working configuration.

BEST MODE TO IMPLEMENT THE INVENTION

With particular reference to these figures, reference number 1 generally designates a levelling spacer system adapted to facilitate the laying of slab-shaped products, such as tiles and the like, generally indicated with the letter P, and suitable for coating surfaces, i.e. (vertical) walls, (horizontal) flooring, ceilings and the like. A system 1 of the "wedge" type will be described hereinafter in detail, for which the advantages connected to the solution which is the object of the present invention are certainly more evident and relevant compared to other types of levelling spacer devices, however it is not excluded that the solution of the present invention can be used in an equivalent manner in different types of levelling spacer devices, such as those of the screw, slider or ring type.

Each tile P, adapted to be laid to coat a (masonry) surface, has a wide laying surface P1, for example lower, and an opposite wide visible surface P2, for example upper, preferably of homologous shape (for example polygonal, preferably quadrangular) with respect to the laying surface P1.

Each tile P then comprises a plurality of side walls P3, generally at right angles to the laying surface P1 and the visible surface P2, which laterally delimit the tile itself.

The system 1 comprises a block 10 configured to allow for the (correct) spacing and/or mutual positioning between adjacent tiles P and to act as a tie-rod in order to level them after an appropriate tensile action, as will be better shown hereinafter. The block 10 comprises a base 20 which is adapted to be placed posteriorly to the laying surface P1 of the tiles P (shown only schematically in FIGS. 16*a*-16*f* and 17).

In the examples shown, the base 20 is defined by a single-piece body, for example made of a plastic material (obtained by injection moulding), which has a substantially polygonal shape (in plan).

In the example shown, the base 20 has an irregular shape (in plan), for example substantially octagonal, elongated along a main (central) axis C.

The base 20 has a symmetrical shape with respect to a median plane M orthogonal to the base itself, for example with respect to a plane orthogonal to the main axis C thereof.

The base 20 comprises a lower surface 21, for example flat or V-shaped.

The lower surface 21 is adapted to be laid on a layer of adhesive arranged on the screed which is intended to be coated by the tiles P; in practice, the lower surface 21 is adapted to be arranged distal to the laying surface P1 of the tiles P in use. The base 20 also comprises an upper surface 22 opposite the lower surface 21, for example flat or suitably shaped/structured (on more levels), adapted to be arranged near the laying surface P1 of the tiles P and, for example, in contact therewith.

The upper surface 22 of the base 20 defines a support plane (continuous or formed by several brackets/support bars) which, in practice, is intended to support a portion of the laying surface P1 of one or more tiles P (flanked to each other).

The upper surface 22 of the base 20 comprises a pair of inclined surfaces opposite to the median plane M of the base 20.

Each inclined surface defines a ramp rising from the end of the base 20 (distal from the median plane M) towards the aforementioned median plane M in a direction orthogonal to the median plane M and connecting the lower surface 21 of the base 20 to the upper surface 22, i.e. to the support plane of the base 20.

The base 20 advantageously comprises a pair of opposite slots (or eyelets) passing from the lower surface 21 to the upper surface 22, which are placed at the central portion of the upper surface 22.

Each slot has an elongated shape, i.e. it has a main extension direction along a longitudinal axis orthogonal to the median plane M of the base 20.

In practice, each slot has a longitudinal axis parallel to the main axis C of the base 20.

Each slot is open laterally at a respective end of the base 20 distal from the median plane M and defines a longitudinal through split of the base 20 from the distal end of the median plane M towards it and with a main direction orthogonal thereto. For example, each slot is adapted to intersect a respective inclined surface splitting it in two separate portions along a direction parallel to the median plane M and to the lower surface 21.

The block 10 further comprises a separating element 30 which rises at right angles from the base 20, for example at the median plane M thereof, which is, in use, adapted to be inserted between facing side walls P3 of at least two (or more) tiles P to be flanked along a flanking direction indicated in the figures with the letter A (parallel to the central axis C and orthogonal to the median plane M of the base 20) and to contact them, substantially defining the width of the interspace (or grout line) between the flanked tiles P.

In practice, the separating element 30 rises (vertically) from the upper surface 22 of the base at right angles thereto and/or to the support plane Q defined by it. The separating element 30 is a slab-shaped parallelepiped body, for example with a rectangular base that defines a thin partition wall.

In particular, the separating element 30 comprises two legs 31 parallel to each other and each rising from (a respective lateral portion of) the upper surface 22 of the base 20, for example in a direction orthogonal to the support plane of the upper surface 22 of the base itself.

The separating element 30 then comprises a cross member 32 which joins the top of the two legs 31 and is arranged with a parallel longitudinal axis and at a distance from the upper surface 22 of the base 20.

In fact, the legs 31 and the cross member 32 define a substantially bridge-like or portal-like shape of the separating element 30.

Preferably, the separating element 30 is made in a single body (single-piece) with the base 20, i.e. for example it is obtained by moulding plastic material together with the base itself (and using the same plastic material).

The separating element 30 is globally defined by a slab-shaped body arranged parallel to the median plane M of the base 20, so that the median plane M of the base 20 is (substantially) also a median plane of the bridge 30 itself (at least of the legs 31 thereof).

Each leg 31 of the separating element 30 has, in the example, a lower end fixed to the upper surface 22 of the base 20.

Each leg 31 or portion thereof of the separating element 30 is connected to the (upper surface 22 of the) base 20 in a breakable/separable manner by means of a predetermined fracture line 310 (i.e. a weakened/thinned section capable of serving as a fracture line for the separation of the separating element 30, i.e. a large portion thereof, from the base 20).

The fracture line 310 is parallel to the support plane defined by the upper surface 22 of the base (and the median plane M) and is placed at a predetermined distance from the lower surface 21 of the base 20.

For example, the predetermined distance of the fracture line 310 may be equal to the distance of the support plane defined by the upper surface 22 of the base from the lower surface 21 (in practice being flush with the support plane itself) or, alternatively, it may be greater than or lower than the distance of the support plane defined by the upper surface 22 of the base from the lower surface 21 (in practice being placed above the support plane or below it—e.g. included in the thickness of the base 20), depending on the construction requirements.

Each leg 31 of the separating element 30 is substantially slab-shaped and has a longitudinal axis (prevailing direction) orthogonal to the support plane defined by the upper surface 22 of the base 20 (from which it originates).

Each leg 31 has a height (in a direction parallel to its longitudinal axis) greater than the thickness (height) of the tiles P to be flanked, so that the cross member 32 of the separating element 30 is always at one level (distance from the support surface defined by the upper surface 22) higher than the level of the visible surface P2 of the tiles P to be flanked.

Each leg 31 has a calibrated thickness which can be constant or variable (e.g. in sections) along the longitudinal axis thereof.

Leg thickness 31 refers to the size of the leg 31 in the direction orthogonal to the median plane M of the separating element 30 which intersects both legs 31 and the cross member 32 of the separating element 30 itself.

Each leg 31 for instance comprises a central sector axially interposed between the cross member 32 and the lower end of the leg 31, wherein the central sector is provided with two flanks 311 opposite to the median plane M and parallel to each other.

The flanks 311 of the central sector are the zone of the leg 31 which substantially comes into contact with the flanked tiles P resting on the central portion of the upper surface 22 of the base 20 substantially defining the mutual distance in a direction orthogonal to the median plane M.

The distance between the flanks 311, i.e. the calibrated thickness of the separating element 30, substantially defines the width of the grout line (interspace) between the tiles P.

Each leg 31 can comprise a small block adapted to interconnect the central sector with the planar surface of the respective lateral portion of the base 20.

The small block has a thickness, i.e. a cross-section made with respect to a plane orthogonal to the median plane M (and parallel to the support plane defined by the base 20), that is lower than the mutual distance between the two flanks 311 of the central sector.

The small block has an upper end connected to the central sector and a lower end, which, as a whole, coincides with the lower end of the leg 31, connected directly to the planar surface of the respective lateral portion of the base 20.

The fracture line 310 is defined at the small block, in a zone proximal to o coincident with the lower end thereof.

The fracture line 310 is defined by a longitudinal notch defining the zone having the smallest cross-section (in any direction and in particular in the direction orthogonal to the median plane M) of the entire leg 31.

The longitudinal notch defining the fracture line 310 defines the zone triggering the fracture of the separating element 30 with respect to the base 20.

The longitudinal notch has a longitudinal axis parallel to the support plane and to the median plane M and is at full length, i.e. it occupies the entire width of the leg 31 (i.e. of the small block).

One or more fracture triggering elements (defined by indentations and/or through-holes with a through-axis orthogonal to the median plane M) may be provided on each longitudinal notch, e.g. placed at or near (at a non-zero distance) an axial end of the longitudinal notch.

Each leg 31, i.e. each small block, comprises a pair of identical fracture lines 310, i.e. longitudinal cuts, symmetrically arranged with respect to the median plane M of the bridge 30 (and of the base 20).

The cross member 32, in the zone interposed between the legs 31, i.e. superimposed on the central portion of the upper surface 22 of the base 20, ends at the bottom with a shaped edge 320, for example with a "V" shape and with the free vertex facing the base 20.

The distance of the shaped edge 320 from the central portion of the upper surface 22 of the base 20 is (abundantly) greater than the thickness of the tiles P to be laid. With its above-described portal shape, the separating element 30 and the base 20 attached thereto delimit a through window 40 which crosses the bridge 30 and the base 20 in a direction orthogonal to the median plane M of the base 20 and/or of the separating element 30.

The through window 40 is peripherally delimited by:

- the cross member 32 (at the top), e.g. from the shaped edge 320 thereof;
- the legs 31 of the bridge 30 (laterally); and
- at least a portion of the upper surface 22 of the base 20 (at the bottom) or by reinforcing/delimiting elements rising from the upper surface 22 itself and contained in the through window 40.

The through window 40 has a substantially rectangular shape.

On the whole, the block 10 (formed by the base 20 and the separating element 30) is made as a single body, e.g. breakable in use at the fracture line 310.

On the whole, the block 10, in the examples shown, is made of a plastic material (and is obtained by injection moulding).

The device 10 further comprises a pressure element, e.g. of the wedge type.

The pressure wedge 50 is defined by a body separate from the base 10 and is configured to co-operate with it for laying and levelling the tiles P.

The pressure wedge 50 is a rectangular wedge, for example it is provided with a flat lower surface 51 and adapted to be arranged, in use, parallel to the support plane of the central portion of the upper surface 22 of the base 20 and an inclined upper surface 52 (with an acute angle, for example lower than 45°) with respect to the lower surface 51 and provided with striker elements, such as teeth 53 or knurls.

The pressure wedge 50 then comprises two parallel flanks (whose distance defines the width of the pressure wedge 50).

The pressure wedge 50 has a variable thickness (and constantly increasing) along its longitudinal axis from a tapered end towards an opposing enlarged end.

Figure 3:
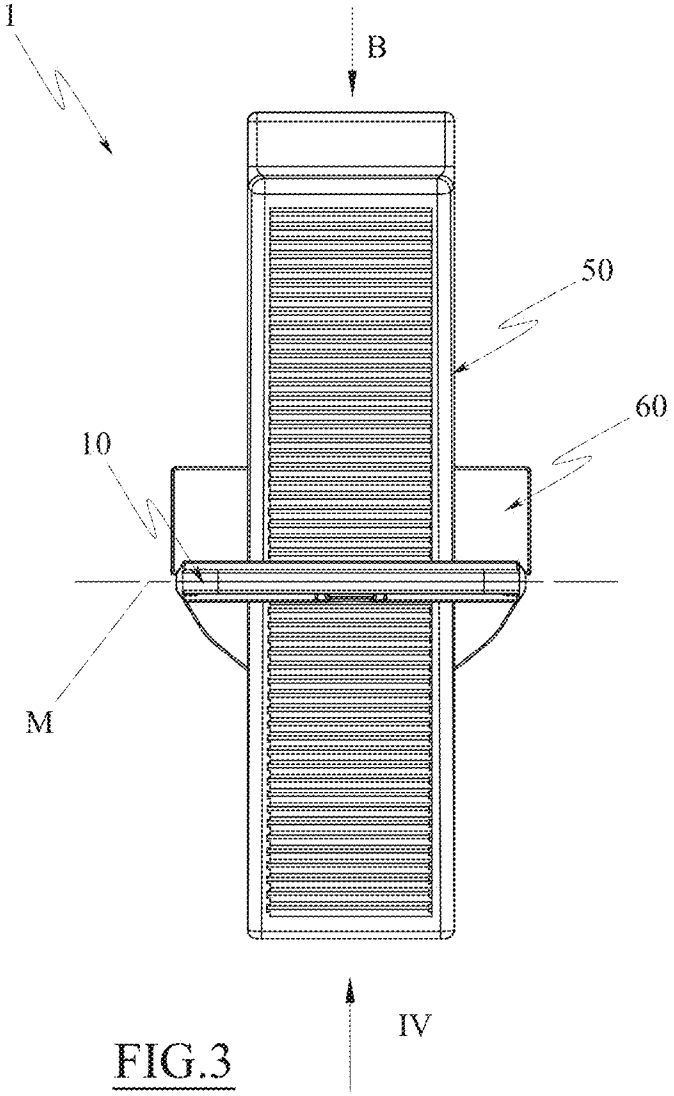
FIG. 3 is a plan view from II of FIG. 1.

The pressure wedge 50 is configured to be axially inserted, through its tapered end, with a clearance, through the through window 40 (defined between the base 20 and the separating element 30) of the block 10 along a crossing direction B in a (single) crossing direction (indicated with an arrow in FIGS. 3 and **16*d*) which is orthogonal to the aforementioned median plane M of the base 20 and/or the separating element 30**.

For example, the maximum height of the pressure element 50 (maximum distance between its lower surface 51 and its upper surface 52, at its enlarged end) is lower than the height of the through window 40 defined by the distance between the cross member 32 (i.e. its shaped edge 320) and the upper surface 22 of the base 20 (i.e. its support plane).

However, the maximum height of the pressure element 50 is greater than the height of the through window 40 and the visible surface P2 of the tiles P resting on the base 20.

The shaped edge 320 of the cross member 32 is able to engage the teeth 53 substantially like a pop-up during the translation movement into the through window 40 along the crossing direction B.

The width of the pressure wedge 50 is substantially equal to (slightly lower than) the distance between the two legs 31 (i.e. between the two facing edges thereof). As described in more detail hereinafter, it cannot be ruled out that the width of the pressure wedge 50 may be substantially lower than the distance between the two legs 31 (i.e. between the two facing edges thereof), e.g. substantially half that distance.

The pressure wedge 50 is suitable to be inserted into the through window 40 through its tapered end and slide in the crossing direction B, with the lower surface 51 facing the visible surfaces P2 of the tiles P resting on the support plane defined by the upper surface 22 of the base 20, so that the upper surface 52 of the pressure element 50 comes into forced contact with the shaped edge 320 of the cross member 32 and the pressure wedge 50 itself generates a pressure in a direction orthogonal to the support plane of the base 20 on both the tiles P, placed on opposite sides with respect to the separating element 30, to push them towards the base 20 and, therefore, level them.

The system 1 comprises, in particular, a plate 60 which is adapted to be interposed —in operation—between the base 20 and the pressure element 50, more precisely between the pressure element 50 (or its lower surface 51) and the visible surface P2 of the tiles P resting on the base 20.

The plate 60 is defined by a body separate from the base and the pressure element 50, and configured to co-operate with them.

In detail, in use the pressure element 50 is movable, for example sliding (relative to the base 20 and to the visible surface P2 of the tiles P inside the through window 40), with respect to the plate 60, which is kept stationary (as will be clearer hereinafter) with respect to the visible surface P2 of the tiles P.

In this case, the plate 60 comprises a slab-shaped body 61, for example with a thin thickness, preferably defined by a single-piece body, advantageously (though not necessarily) made of a plastic material (obtained by injection moulding).

The plate 60, i.e. the slab-shaped body 61 thereof, comprises a lower (major) face (configured to face the base 20 or the visible surface P2 of the tiles P, when in use) and an opposing lower (major) face (configured to face the pressure wedge 50, when in use).

The plate 60, i.e. the slab-shaped body 61 thereof, comprises—at its lower face—a first (lower) surface 610, which is intended to face the base 20 (i.e. facing the upper surface 22 of the base itself), when in use (i.e. when the plate 60 is axially interposed between the base 20 and the pressure wedge 50 themselves).

In more detail, the first surface 610 is configured to contact (rest against) the visible surface P2 of the tiles P, during use, i.e. at least two flanked tiles P resting with their laying surface P1 on the upper surface 22 of the base 20.

The first surface 610, in use, is adapted to contact the visible surface P2 of the tiles P remaining substantially integral thereto (stationary, without creeping) during the translation movement with which the pressure wedge 50 engages the through window 40.

Preferably, the first surface 610 of the lower face of the plate 60 (i.e. of the slab-shaped body 61 thereof) is planar, i.e. lies on a plane (so that the visible surface P2 of the tiles P can be levelled on such a plane, as will better appear hereinafter).

The first surface 610, for example, extends for most of the lower face of (the slab-shaped body 61 of) the plate 60.

It is not excluded, however, that the first surface 610 may extend over a limited (though evenly distributed) area of the lower face of (the slab-shaped body 61 of) the plate 60.

In addition, the plate 60 comprises—at its upper face—a second (upper) surface 611, opposite to the first surface 610, which is intended to face the pressure wedge 50, when in use.

In more detail, the second surface 611 is configured to contact (creeping, e.g. along a straight creeping trajectory) the lower surface 51 of the pressure wedge 50 during use, i.e. during a translation movement of the pressure wedge 50 into the through window 40 in the crossing direction B.

The second (planar) surface 611 could affect (occupy) the entire area of the upper major face of the plate 60 or most of it (as shown).

Alternatively, the second surface 611 could only affect a portion (i.e. a full length elongated strip) thereof.

In such a case, for example, the upper face could comprise a full length longitudinal channel along the crossing direction B, wherein the longitudinal channel defines a planar bottom surface, defining a second central auxiliary surface 611 parallel to two opposing top surfaces, also planar, which together define the second surface 611.

A (straight) step is defined between the second surface 611 (defined on either side of the longitudinal channel) and the second central auxiliary surface 611.

Thanks to this configuration, a pressure wedge 50 with a width lower than that of the longitudinal channel can slide on the central auxiliary upper surface 611 (kept guided along the crossing direction B within the longitudinal channel by the side borders thereof defined by the steps), on the other hand, a pressure wedge 50 with a width greater than that of the longitudinal channel can slide on the upper surface 611 (defined at the sides of the longitudinal channel), e.g. kept guided along the crossing direction B by the inner edges of the through window 40 of the block 10. In the cases shown, the first surface 610 and the second surface 611 are parallel to each other (and the distance between them defines the thickness of the slab-shaped body 61).

It is not excluded, however, that the second surface 611 may be inclined (by an acute angle, e.g. lower than 45°) with respect to the first surface 610, so as to define a ramp rising in the crossing direction imposed to the pressure wedge 50.

The slab-shaped body 61 has an elongated shape along a longitudinal axis D, which in use is intended to be arranged parallel to the crossing direction B.

In the preferred embodiment shown in FIGS. 1-10, the plate 60 (i.e. the slab-shaped body 610 thereof) has a substantially polygonal plan shape, in the example elongated along a longitudinal axis D.

In the example, the plate 60 has an overall plan shape of a (one-way) arrow, so as to identify a rear (or tail) longitudinal end and an opposite front (head) longitudinal end.

Thanks to this arrow-like shape (of the slab-shaped body 610) of the plate 60, it is possible to visually identify a preferential sliding direction (from the rear longitudinal end to the front longitudinal end) that guides the sliding of the pressure wedge 50 in the only possible crossing direction within the through window 40 and, at the same time, identifies the correct positioning of the plate 60 (with respect to the pressure wedge 50).

Figure 11:
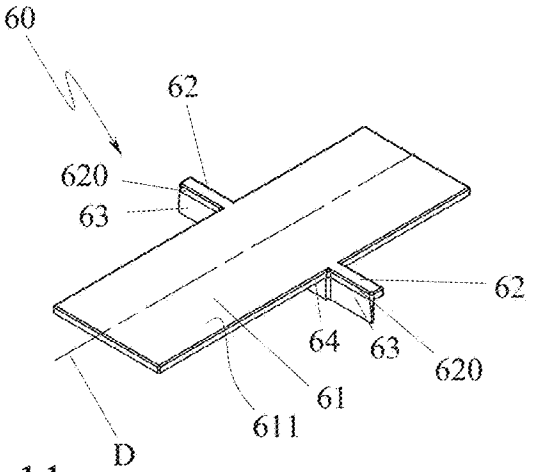
FIG. 11 is an upper axonometric view of a plate of a second embodiment of the levelling spacer system according to the invention.
Figure 12:
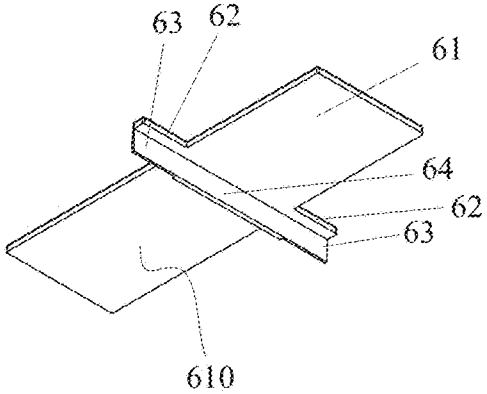
FIG. 12 is a first lower axonometric view of FIG. 11.
Figure 13:
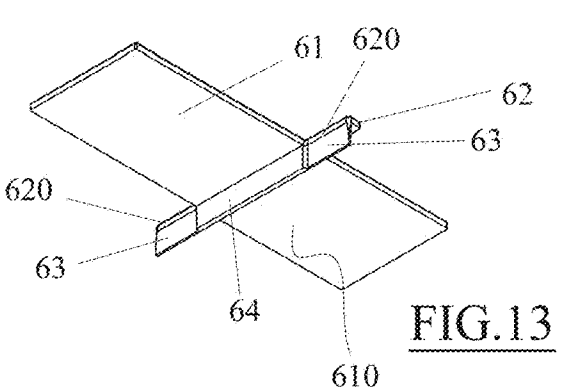
FIG. 13 is a second lower axonometric view of FIG. 11.
Figure 14:
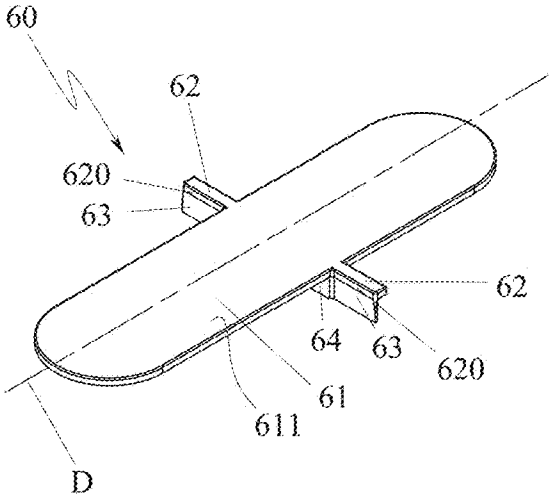
FIG. 14 is a lower axonometric view of a plate of a third embodiment of the levelling spacer system according to the invention.
Figure 15:
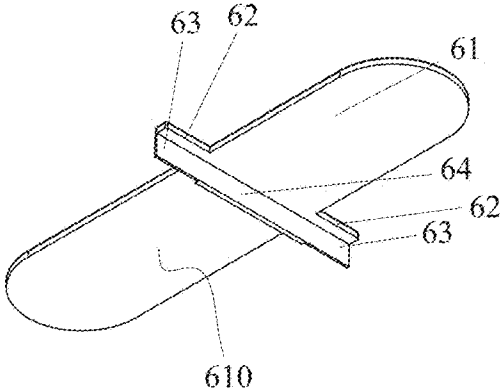
FIG. 15 is a lower axonometric view of FIG. 14.

It is not excluded, however, that the plate 60 may have a different shape, such as rectangular (as shown in FIGS. 11-13) or with rounded ends (as shown in FIGS. 14-15).

The plate 60 (i.e. its slab-shaped body 61), for example, has no slots or through-holes (in the thickness), i.e. it is a solid body.

It is not excluded that the plate 60 may have a perforated structure provided with one or more (lightening) holes, either blind or passing through the thickness, but these are of such a shape and/or size that they cannot be inserted (in any way) onto the separating element 30 of the base 10.

The plate 60, i.e. the slab-shaped body 61 thereof, is configured to be inserted at least partially inside the through window 40, with its first surface 610 parallel to the support plane defined by the upper surface 22 of the base 20.

In particular, the plate 60, or the slab-shaped body 61 thereof, has an axial insertion section, which comprises the front longitudinal end thereof.

The axial insertion section is, for example, at least one-third as long (along the longitudinal axis D) as the total length of the plate 60, e.g. substantially half the length of the plate 60.

The plate 60, and in particular the axial insertion section thereof, has a width (meaning the dimension orthogonal to the thickness and length) lower (by a few millimetres, but lower than one centimetre) than the width of the through window 40 (i.e. the inner distance between the legs 31 of the separating element).

In practice, the plate 60, in particular the axial insertion section thereof, is configured to fit substantially to measure (between the legs 31 of the separating element 30) into the through window 40, despite with plenty of clearance along the dimension parallel to its thickness.

The plate 60, i.e. the slab-shaped body 61 thereof, is suitable to be axially inserted into the through window 40 by its front axial end and, gradually, its axial insertion section and to slide in the crossing direction (concordant to the crossing direction imposed to the pressure wedge 50) of the crossing direction B, with the first surface 610 facing the visible surfaces P2 of the tiles P resting on the support plane defined by the upper surface 22 of the base 20, so that the second surface 611, as will be better described hereinafter, faces the shaped edge 320 of the cross member 32. According to an aspect of the invention, the plate 60 comprises at least one striker element 62 configured to abut against at least one rear portion of the separating element 30, in particular against a flank 311 of a leg 31 which is facing posteriorly in the crossing direction imposed to the pressure wedge 50, during the insertion of the plate 60, i.e. of its axial insertion section within the through window 40 along the crossing direction (in the same crossing direction to be imposed to the pressure wedge 50).

Preferably, the plate 60 comprises a pair of opposing striker elements 62, each of which is configured to abut against a respective rear portion of the separating element 30, in particular each against a flank 311 of a respective leg 31 that is facing posteriorly in the crossing direction imposed to the pressure wedge 50, during insertion of the plate 60, or of its axial insertion section within the through window 40 along the crossing direction (in the same crossing direction to be imposed to the pressure wedge 50).

Furthermore, each striker element 62 is defined by a lateral flap branching off laterally from the slab-shaped body 61, e.g. at right angles thereto.

In practice, each striker element 62 defines an enlarged portion of the plate 60 that axially (and functionally) distinguishes/separates the axial insertion section of (the slab-shaped body 61 of) the plate 60 from the axial rear (non-insertion) section thereof.

In practice, each striker element 62 laterally originates from the slab-shaped body 61 by a width substantially equal to (or slightly greater than) the (maximum) width of a leg 31 of the separating element 30.

In the example, each striker element 62 comprises an upper surface and a lower surface, which are substantially coplanar to the first surface 610 and to the second surface 611 of the plate 60 (i.e. the slab-shaped element 61).

Each striker element 62 has a front edge 620 (orthogonal to the upper surface and bottom surface) and, for example, an opposing rear edge (e.g. orthogonal to the upper surface and bottom surface and preferably parallel to the front edge 620).

The rear edge can be arranged at the rear axial end of the plate 60 or (as in the version shown) at an axial distance therefrom, e.g. lower than (or equal to or greater than) the length of the axial insertion section.

The front edge 620 defines the support and abutment surface of the striker element 62 against the rear portion of the separating element 30, in particular against the flank 311 of a leg 31 which is facing posteriorly in the crossing direction imposed to the pressure wedge 50, during insertion of the plate 60, i.e. of its axial insertion section within the through window 40 along the crossing direction (in the same crossing direction to be imposed to the pressure wedge 50).

The front edge 620 is substantially at right angles to the longitudinal axis D of the plate 60 (defining an essentially parallel/coplanar support for the flank 311 of the respective leg 31).

In addition, the front edges 620 of the two striker elements 62 are coplanar with each other (so that they can simultaneously abut on the two flanks 311 of the legs 31 of the separating element 30).

The front edge 620 of each striker element 62 delimits posteriorly the axial insertion section of (the slab-shaped body 61 of) the plate 60 (e.g. by defining a right dihedral angle with a side wall thereof).

In practice, the striker element 62 (when the front edge 620 thereof contacts the rear flank 311 of the leg 31) defines a mechanical end-stop for the plate in the crossing direction along the crossing direction B.

Thanks to the striker element 62, the plate 60 remains stationary on the visible surfaces P2 of the tiles P during the insertion of the pressure wedge 50 into the through window 40 (remaining interposed therebetween), so that the plate 60 exerts an anti-scratch/anti-creeping function by preventing the pressure wedge 50 (and other movable elements) from creeping in direct contact with the visible surface P2 of the tiles P.

The plate 60 further comprises at least one blade 63 configured to be inserted between a side wall P3 of a tile P, i.e. the rear tile in the crossing direction of the pressure wedge 50, and the separating element 30, i.e. the (aforesaid) rear portion of the separating element 30, in particular defined by the flank 311 of a leg 31 which is facing posteriorly in the crossing direction imposed to the pressure wedge 50. In detail, the blade 63 projects and protrudes downwardly (from the lower face of the plate 60) from the first surface 610 of (the slab-shaped body 61 of) the plate 60.

In particular, the blade 63 extends in a direction substantially at right angles with respect to the first surface 610 of (the slab-shaped body 61 of) the plate 60 (and/or with respect to the bottom surface of the striker element 62).

Advantageously, the blade 63 is joined to (and departs/originates from) a striker element 62 (cantilevered from it).

Preferably, the plate 60 comprises a pair of blades 63, one for each striker element 63.

In practice, each blade 63 has a first (upper/proximal) end which is constrained to the striker element 62 (of the plate 60), i.e. originating from and joined to the lower surface thereof, and an opposing second free end (which is placed on the opposite side of the second surface 611 relative to the first surface 610).

The first end of the blade 63 is directly connected to the front edge 620 of the striker element 62, e.g. for the entire length thereof or for one or more limited sections thereof.

The blade 63 actually extends the front edge of the striker element 62 in a direction orthogonal to the first surface 610 (downwards).

The height of the blade 63 (defined by the distance between the first end and the second end thereof) is lower than the thickness of the tiles P intended to be laid/levelled with the system 1 (so that the second end cannot come into contact with the base 20).

The blade 63, therefore, has a front face (in the aforementioned crossing direction) and an opposing (and parallel) rear face.

The front face of the blade 63, which is, for example, planar, is substantially flush (i.e. coplanar) with the front edge 620 (which defines the abutment surface) of the striker element 62.

The front face of each blade 63 is intended to contact at least a portion of the flank 311 of the respective leg 31 of the separating element 30.

The front face of each blade 63 is substantially at right angles to the first surface 610.

The front faces of the blades 63 are substantially coplanar to each other, as well as the rear faces of the blades 63 are substantially coplanar to each other.

The rear face of each blade 63 is substantially at right angles to the first surface 610.

In practice, a right concave dihedral angle is defined between the lower surface of each striker element 62 and the rear face of the respective blade 63, within which an upper edge of a tile P (rear, in the aforesaid crossing direction) is intended to be accommodated, i.e. the upper edge is such that the tile P is arranged with the visible surface P2 in contact with the lower surface of the striker element 62 and the rear face of the blade 63 with the (front) side wall P3 of the same tile P. In addition, a right convex dihedral angle is defined between the upper surface of each striker element 62 and the front face of the respective blade 63, configured to contact the rear flank 311 of the respective leg 31 of the separating element 30 and thus prevent the contact/rubbing of the leg 31 with (the upper edge of) the tiles P. In other words, each blade 63 (and its respective striker element) covers a portion of the upper edge of the (rear) tile P in order to avoid contact between it and the rear flank 311 of the legs 31 of the separating element 30.

Preferably, the thickness of the blade 63 (i.e. the distance between the front surface and the rear surface thereof) is lower than or equal to, preferably lower than, the thickness of (the slab-shaped body 610 of) the plate 60.

Advantageously, the thickness of the blade 63 is lower than or equal to 0.5 mm (so as not to excessively widen the grout line between the tiles P).

Furthermore, the plate 60 can comprise a reinforcing plate 64 that joins the (two) blades 63 (below the first surface 610 of the plate 60).

In practice, the reinforcing plate 64 projects transversally in a direction orthogonal to the longitudinal axis D of the plate 60, so as to connect the two blades 63.

The reinforcing plate 64 is, for example, in a single body with the blades 63 and is configured to be inserted into the grout line between the side walls P3 of the tiles flanked along the flanking direction, e.g. in contact with the side wall P3 of the rear tile P (in the crossing direction imposed to the pressure wedge 50).

The reinforcing plate 64, for example, is suitable to be inserted at least partially into the through window 40.

In detail, the reinforcing plate 64 projects and protrudes downwardly from (the lower face of the plate 60, in particular from) the first surface 610 of (the slab-shaped body 61 of) the plate 60.

In particular, the reinforcing plate 64 extends in a direction substantially at right angles to the first surface 610 of (the slab-shaped body 61 of) the plate 60 (and/or with respect to the bottom surface of the striker member 62).

In practice, the reinforcing plate 64 has a first (upper/proximal) end constrained to the first surface 610 (of the plate 60), i.e. originating from and joined to it, and an opposing second free end (which is placed at the opposite side of the second surface 611 relative to the first surface 610).

The height of the reinforcing plate 64 (defined by the distance between the first end and the second end thereof) is substantially equal to the height of the blades 63 it joins.

The reinforcing plate 64 has an axial end that originates from (or is joined to) a blade 63 and an opposing axial end that originates from (or is joined to) the other blade 63.

The reinforcing plate 64 has a front face (in the aforementioned crossing direction) and an opposing (and parallel) rear face.

The front face of the reinforcing plate 64, which is, for example, planar, is substantially arranged anteriorly (or at the limit coplanar) to the front face of the blades 63.

The front face of each blade 63 is intended to enter by a limited section into the through window 40.

The rear face of the reinforcing plate 64, which is, for example, planar, is essentially flush (i.e. coplanar) with the rear face of the blades 63.

The rear face of the reinforcing plate 64 is substantially at right angles to the first surface 610.

In practice, a right concave dihedral angle is defined between the first surface 610 of the slab-shaped body 610 (at the rear axial section thereof) and the rear face of the reinforcing plate 64, within which the upper edge of one or two tiles P (rear, in the above-mentioned crossing direction) is intended to be accommodated, i.e. the upper edge is such that the tile(s) P is/are arranged with the visible surface P2 in contact with the first surface 610 of the slab-shaped body 610 (at the rear axial section thereof) and the rear face of the reinforcing plate with the (front) side wall P3 of the same tile(s) P.

Preferably, the thickness of the reinforcing plate 64 (i.e. the distance between the front surface and the rear surface thereof) is greater than or equal to, preferably greater than, the (maximum) thickness of each blade 63 (and lower than or equal to the thickness of the legs 31 of the separating element, defined by the distance between the flanks 311 of a leg 31).

Advantageously, the thickness of the reinforcing plate 64 is between 1 mm and 0.5 mm (subject to machining tolerances).

When the axial insertion section of the plate 60 is in position, it is configured to support the tapered (front) end of the pressure wedge In light of the above, the operation of the system 1 is as follows.

To coat a surface with a plurality of tiles P it is sufficient to apply a layer of adhesive thereon and, subsequently, it is possible to lay the tiles P with the laying surface P2 facing towards and in contact with the layer of adhesive.

In practice, in the location where the first tile P must be arranged, it is sufficient to position a first block 10, the base 20 of which is intended, for example, to be placed under two edges of respective tiles P, one edge and two corners of three respective tiles P or four corners of four respective tiles P, depending on the desired laying pattern.

Once the base 20 has been positioned, it is sufficient to position the tiles P so that a portion of the side wall P3 of each or one tile P is substantially in contact respectively with a flank 311 of one or both legs 31.

The same distance is thereby ensured between the two/three/four tiles P which surround the separating element 30 of the device 10 and they rest on the support plane of the base 20. When, for example, the tiles P have particularly large dimensions, it is then possible to also position a block 10 at a median area of the side wall P3 of the tile itself.

The operation generally takes place by first laying a tile P and subsequently inserting, at the corner or side wall thereof, a base portion 20 of the block 10.

Once the various blocks 10 have been positioned, as long as the adhesive is still not completely solidified, a plate 60 is firstly inserted (see FIGS. 16*b*-16*c*) at least partially inside the portion rising from the plane of the visible surfaces P2 of the tiles of the through window 40.

In practice, it is sufficient to insert the front axial end and the insertion axial section of (the slab-shaped body 610 of) the plate 60 into the through window 40 (with the first surface 610 facing the tiles P and at a distance from them) in the crossing direction B.

When the striker element 62 comes into contact with the rear flanks 311 of the legs 31, it is sufficient to lower the plate 60, so as to insert the blades 63 (and the reinforcing plate 64) within the grout line of the tiles P (between the side wall P3 of the rear tile and the rear flank 311 of the legs 31), until the first surface 610 of (the slab-shaped body 610 of) the plate 60 comes into contact/rest on the visible surface P2 of the tiles P.

In arranging the plate 60, it is necessary to take into consideration the desired crossing direction B to impose on the pressure wedge 50, as it is necessary to arrange the plate 60 so that the blade 63 is located posteriorly to the separating element 30 in the crossing direction of the separating element 30 by the pressure wedge 50.

When the first surface 610 of the plate 60 is brought into contact with the visible surface of one or more tiles P which surround the separating element 30 (see FIG. 16*d*), each blade 63 is inserted in the apical portion of the grout line, in particular in the gap defined (or which is defined) between a pair of coplanar flanks 311 of the separating element 30 and (the apical portion of) the side wall P3 of the tile(s) P facing them.

Thereby, the apical portion (i.e. the upper corner) of the side wall P3, which joins the visible surface P2 and the side wall P3, of the tile P is not in direct contact with the separating element 30, but the blade 63 is interposed between them.

Figure 16A:
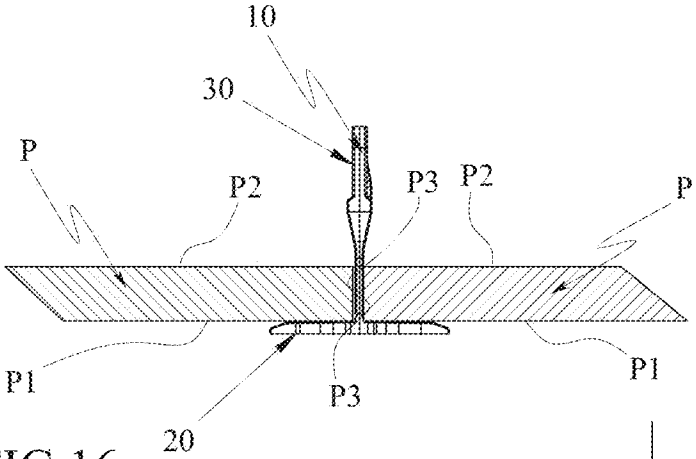
Figure 16B:
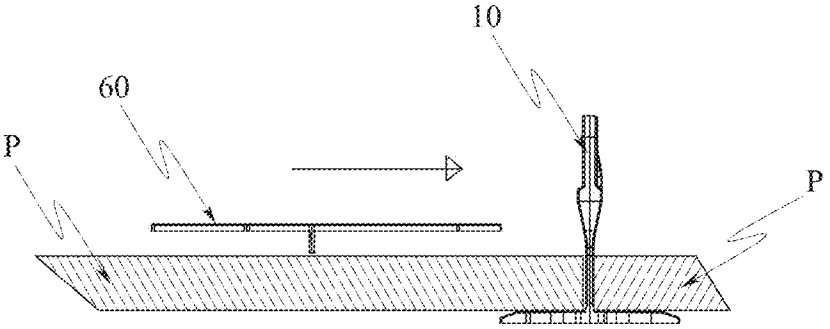
Figure 16C:
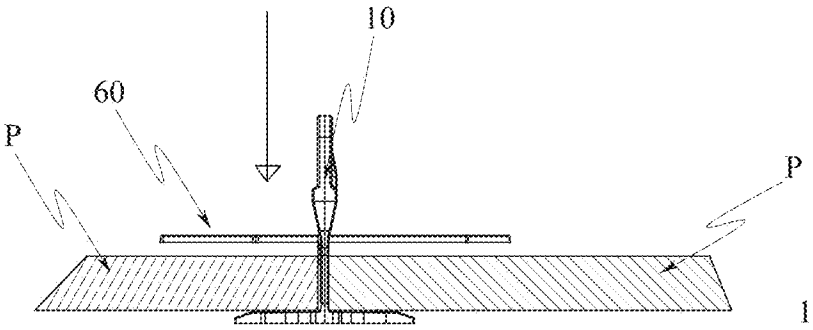
Figure 16D:
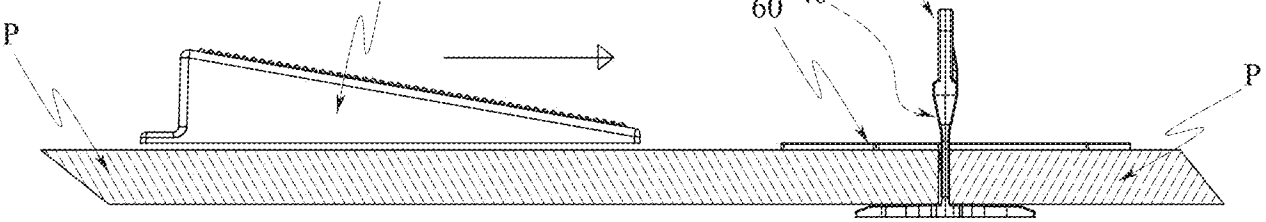
Figure 16E:
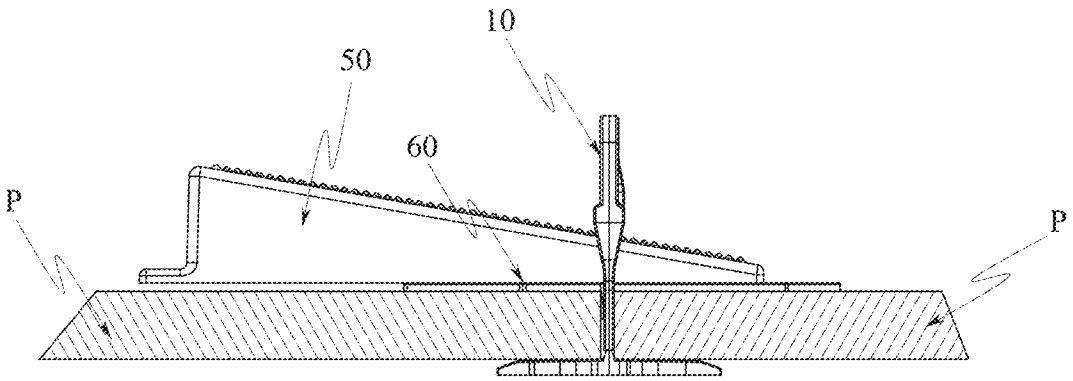

At this point, as long as the adhesive has not yet completely solidified, the various pressure wedges 50 are inserted into each through-opening 40 by inserting them from the tapered end (see FIGS. 16*d*-16*e*).

As the pressure wedge 50 is fed in its crossing direction B along the feed direction B and is inserted progressively into the through window 40, the pressure wedge 50 gradually presses on the visible surface P2 (by means of the interposition of the plate 60) of the tiles P, locally at the various points (median or corner), allowing the perfect levelling of the visible surfaces P2 of the tiles P themselves.

The insertion of the pressure wedge 50 can be carried out and facilitated by special gripper devices, as known to those skilled in the art, which in fact exert a compression (represented with the arrows F in FIG. 16*f*) between the enlarged end of the pressure wedge 50 and the face (of the portion rising from the tiles P) of the separating element 30 opposite the face thereof which comprises the flanks 311 in contact with the blades 63.

The plate 60 (with its anti-scratch function) allows to safeguard the visible surface P2 of the tiles P from the rubbing action by the pressure wedge 50, but further allows to safeguard the apical or corner portion of the tiles P from indentation or detachment of part of the visible surface P2.

Figure 16F:
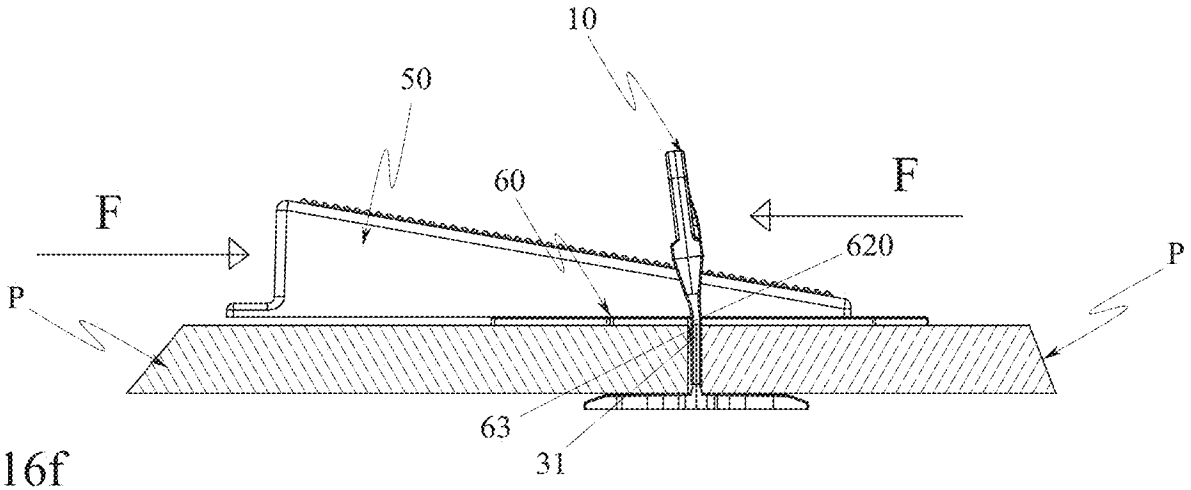

In fact, as it can be seen in FIG. 16*f*, the compression which allows the insertion of the pressure wedge 50 into the through window 40 and the consequent levelling of the visible surfaces P2 of the tiles P is such as to cause—especially in the final insertion steps—a deformation of the separating element 30, which tends to bend posteriorly with respect to the crossing direction B imposed to the pressure wedge 50.

This rear bending, together with the elongation in a direction moving away from the base 20 caused by the component normal to the base 20 of the traction exerted by the pressure wedge 50 on the separating element 30, is discharged (rather than on the apical portion of the tiles P, as it instead can occur in the known devices) on the blade 63, which in fact protects this apical portion of the tiles P, avoiding the local detachment or breaking/indentation of the visible surface P2 of the tiles P (especially when the tiles P are glazed).

Finally, when the adhesive has hardened and is in place, the separating element 30 is removed, causing, for example by means of an impulsive force, the triggering of the (fragile) fracture along the fracture line 310 of the separating element 30 from the base 20.

In practice, it is possible to remove the (disposable) separating element 30 and the (reusable) pressure element 50 and plate 60 so as to be able to fill the grout lines between the tiles P without the base 20 being visible on the finished surface and substantially no part of the base 20 nor the separating element 30 remains interposed between the tiles themselves.

The invention claimed is:

1. A levelling spacer system for laying tiles for coating surfaces, comprising:

a block equipped with a base positionable posteriorly to a laying surface of at least two tiles arranged adjacent and flanked with respect to a flanking direction; and a separating element which rises from said base at right angles thereto and is configured to be inserted between side walls facing said two flanked tiles, wherein the separating element comprises a through window, a shaped edge of which facing the base is placed at a distance from the base greater than a maximum height of a visible surface of the tiles from the base itself;

a pressure wedge suitable to be inserted at least partially into the through window between the visible surface of the tiles and the shaped edge along a crossing direction parallel to the flanking direction; and a plate configured to be interposed between the pressure wedge and the visible surface of the tiles with its first surface facing the base, wherein the plate is configured to be inserted at least partially into the through-window between the visible surface of the tiles and the pressure wedge along the crossing direction, wherein the plate comprises at least one striker element configured to abut on the at least one rear portion of the separating element during the insertion of the plate into the through window along the crossing direction.

2. The system according to claim 1, wherein the separating element is provided with two legs flanked to each other along a flanking direction orthogonal to the crossing direction and each rising from the base and a cross member joining the top of the two legs, the cross member comprising the shaped edge, and wherein the plate comprises two striker elements each of which is configured to abut on at least one rear portion of a respective leg of the separating element during insertion of the plate into the through window along the crossing direction.

3. The system according to claim 1, wherein the plate comprises at least one blade configured to be inserted between a side wall of a tile and the separating element.

4. The system according to claim 1, wherein the blade departs from the striker element so that a front face of the blade is substantially flush with an abutment surface of the striker element.

5. The system according to claim 2, wherein a respective blade departs from each striker element at right angles to the first surface of the plate facing the base and configured to be inserted between a side wall of a tile and a rear portion of a respective leg of the separating element.

6. The system according to claim 1, wherein the striker element and the blade are configured to cover an edge of at least one tile joining a side wall and the visible surface thereof.

7. The system according to claim 5, wherein the plate comprises a reinforcing plate joining the blades, wherein the reinforcing plate is at right angles to the first surface of the plate and has a thickness greater than or equal to a maximum thickness of each blade.

8. The system according to claim 1, wherein the pressure wedge is provided with a longitudinal axis and has a tapered end and an opposing enlarged end, wherein the pressure wedge is configured to be inserted into the through window on the side of the tapered end and to slide along the crossing direction resting on a second surface of the plate opposing the first surface cooperating with said shaped edge for pushing the tiles themselves towards the base.

9. The system according to claim 8, wherein the second surface of the plate is either parallel to the first surface and completely planar or has a full length longitudinal channel along the crossing direction, wherein the longitudinal channel defines a central planar bottom surface and is parallel to two opposing planar top surfaces.

10. The system according to claim 8, wherein the second surface of the plate is inclined with respect to the first surface, so that the plate has an increasing thickness in the crossing direction.

* * * * *